US006382469B1

(12) United States Patent
Carter et al.

(10) Patent No.: US 6,382,469 B1
(45) Date of Patent: May 7, 2002

(54) TIRE INFLATION ACTUATOR

(75) Inventors: Randall E. Carter, Waynesfield; Leslie F. Kohli, Cridersville; Brian D. Schumacher, Wapakonetta, all of OH (US)

(73) Assignee: Precision Thermoplastic Components, Inc., Lima, OH (US)

( * ) Notice: Subject to any disclaimer, the term of this patent is extended or adjusted under 35 U.S.C. 154(b) by 0 days.

(21) Appl. No.: 09/919,548

(22) Filed: Jul. 31, 2001

(51) Int. Cl.[7] ..... B65D 83/00

(52) U.S. Cl. ..... 222/153.06; 222/153.12; 222/402.13; 222/402.14

(58) Field of Search ..... 222/153.06, 153.12, 222/153.13, 402.13, 402.14; 141/38

(56) References Cited

U.S. PATENT DOCUMENTS

| | | | | |
|---|---|---|---|---|
| 4,171,758 | A | 10/1979 | Corba | |
| 4,260,080 | A | 4/1981 | Gailitis | |
| 4,278,188 | A | 7/1981 | Stephenson et al. | |
| 4,315,576 | A | 2/1982 | Murphy et al. | |
| 4,350,299 | A | 9/1982 | Stephenson et al. | |
| 4,381,065 | A | 4/1983 | Hayes | |
| 4,420,099 | A | 12/1983 | Pizzurro et al. | |
| 4,428,509 | A | 1/1984 | Emerson et al. | |
| 4,941,600 | A | 7/1990 | Berriochoa et al. | |
| 5,119,970 | A | 6/1992 | Arieh et al. | |
| 5,305,784 | A | 4/1994 | Carter | |
| 5,403,417 | A | 4/1995 | Dudley et al. | |
| 5,503,303 | A | 4/1996 | LaWare et al. | |
| D373,082 | S | 8/1996 | Ferrara, Jr. | |
| D380,384 | S | 7/1997 | Ferrara, Jr. | |
| 5,702,036 | A | 12/1997 | Ferrara | |
| 5,765,601 | A | 6/1998 | Welle et al. | |
| 6,126,044 | A | * 10/2000 | Smith | 222/402.14 |

* cited by examiner

*Primary Examiner*—Philippe Derakshani
(74) *Attorney, Agent, or Firm*—Robert R. Hussey Co., LPA

(57) ABSTRACT

An actuator for dispensing the pressurized contents of a container through an upstanding valve stem having a discharge end. The actuator has a body securable to the container and a finger tab for dispensing the container contents upon actuation thereof and a latch to selectively hold the finger tab in the dispensing position or release the finger tab. The finger tab has a valve seat shoulder for contacting the discharge end of the valve stem and is rotatable about a rotational axis which is substantially coplanar with the discharge end of the valve stem in the unactuated position. Resistance reducing notches are provided in the body to allow improved movement of the finger tab. Frangible ribs are provided to avoid the inadvertent actuation of the actuator and also guide movement of the finger tab.

25 Claims, 9 Drawing Sheets

TIRE INFLATION ACTUATOR

BACKGROUND OF THE INVENTION

The present invention relates in general to actuators and more particularly to actuators for dispensing the pressurized contents of a container through an upstanding valve stem releasably securable in a discharge condition with improved operating features.

Modern pneumatic tires are designed for extended use on vehicles, such as automobiles and trucks, over many miles. Regardless of how well these tires are designed, they can still be punctured by sharp objects inadvertently left on the roadway and go flat. When the tire is punctured, the motorist must change the tire if he has a spare or have another tire put on the vehicle. In some instances, it is difficult to change the tire due to the location of the vehicle, such as when the puncture occurs on roadway which is not flat and the vehicle cannot be safely raised with a jack to change the tire. Another instances is dangerous to change the tire, such as for example, when the tire is punctured on a heavily traveled roadway and there is not sufficient space to change the tire safely.

Various tire inflator and sealant products have been developed for both sealing the puncture in a tire and also inflating the tire so that it can be used to resume travel where the tire puncture may be repaired. These tire inflator and sealant products generally include a container having a inflator and sealant composition contained therein under pressure. This composition is releasable through an upstanding valve in the discharge end of the container. These compositions in the container typically include a liquefied gas in a sufficient quantity to re-inflate the tire to a driveable condition and a sealant material for sealing the puncture when introduced into the tire.

An actuator is provided for attachment to the pressurized container to activate the upstanding valve so that the inflator and sealant composition passes through the valve and then through the actuator to a discharge tube attached to the valve on the tire. In operation, the motorist attaches the discharge tube to the valve on the punctured tire and then properly positions the canister to maximize the flow of the inflator and sealant composition into the tire. Some canisters are designed to be actuated in either an up or inverted position, that is with the upright stem in either an upward or inverted, downward position. The motorist then uses his finger to activate the actuator which in turn activates the valve in the pressurized container to release the inflator and sealant composition into the tire.

If the motorist inadvertently or accidentally depresses the actuator before he is ready to inflate and seal the punctured tire, the inflator and sealant composition is not introduced into the tire and the tire inflator and sealant product escapes. Accidental activation of the actuator can also occur in a wide variety of circumstances in handling the pressurized container. Accordingly, it is desirable to provide an actuator which safeguards against inadvertent or accidental actuation of the actuator. In addition, the manufacturing process for assembling the actuator to the container may exert a force on the actuator and it is desirable to provide an actuator which avoids actuation of the actuator during the manufacturing process. On the other hand, it is desirable to provide an actuator that is easy to activate without requiring substantial finger pressure on the actuator to move it from an unactivated to an activated position, while providing an actuator which moves to an unactivated position when the finger pressure is removed from the actuator.

As the motorist actuates or depresses the actuator, the inflator and sealant composition flows into the actuator from the canister valve and proceeds through the discharge tube and then through the valve on the punctured tire into the tire. If the inflator and sealant composition is allowed to escape at the junction between the actuator and the valve on the canister both the inflator and sealant are not introduced into the tire. Accordingly it is desirable to provide an actuator which maintains the connection between the actuator and the valve on the canister so that the inflator and sealant does not escape at that junction.

Once the inflator and sealant composition is flowing into the punctured tire, maintaining finger pressure on the actuator to keep it in an activated condition can be difficult and strenuous for the motorist. Accordingly, it is desirable to provide a latch for holding the actuator in the activated position while the inflator and sealant composition flows into the punctured tire. Since pneumatic tires have a wide variety of sizes and internal volume, different tires require different amounts of inflator and sealant composition. In order to avoid unnecessary use of the inflator and sealant composition and allow the canister to be used in another punctured tire situation, it is desirable to provide an actuator with a latch which is readily releasable when a sufficient amount of inflator and sealant composition has been introduced into the punctured tire.

It is also desirable to provide an actuator which returns to its unactivated position when the latch is released. Occasionally it is desirable to release small amounts of the inflator and sealant composition and accordingly it is desirable to provide an actuator which can manually be activated without using the latch so that when finger pressure is released, the actuator returns to an unactivated position.

SUMMARY OF THE PRESENT INVENTION

The present invention provides the above described desirable features with an improved actuator. The actuator of the present invention is used with a container having an upstanding valve stem with pressurized contents contained therein. The actuator is capable of either continuously or intermittently dispensing the pressurized contents of the container. To achieve this feature, the actuator of the present invention has a generally cylindrical body which is attachable to the container and has a central aperture therethrough for receiving the upstanding valve stem of the container. The central aperture extends generally along a central axis. The pressurized contents of the container is released through the discharge end of the valve stem.

The actuator has a finger tab which is positioned across the central aperture of the body and has a stem receiving aperture for receiving the upstanding valve stem of the container therein. The stem receiving aperture terminates in a valve seat shoulder which contacts the discharge end of the valve stem. The finger tab also has a discharge orifice formed in the side surface of the finger tab. Upon movement of the finger tab to depress and activate the valve stem, the pressurized contents flows through a passageway in the finger tab extending from the valve seat shoulder to the discharge orifice.

To connect the finger tab to the body, the actuator has an hinge portion which allows for movement of the finger tab between an unactuated position in which the valve stem is not actuated and an actuated position in which the valve stem is actuated to release the pressurized contents of the container.

The actuator hinge portion of the present invention provides an actuator that is easy to activate without requiring substantial finger pressure on the actuator to move it from an unactivated to an activated position. The actuator hinge portion has a body connecting portion, and an upright intermediate portion extending in a direction substantially parallel to the longitudinal axis of the body and is separated from the body by notches extending from the top edge of the cylindrical body toward the bottom edge of the cylindrical body to a position below a plane vertical to the central axis and passing through the discharge end of the valve stem when the container is attached to the actuator. The actuator hinge portion also has a finger tab connecting portion connecting the upright intermediate portion to the finger tab. The notches reduce the force required to move the finger tab from the unactuated position to the actuated position.

The actuator of the present invention provides an improved connection between the finger tab and the discharge end of the valve stem which maintains the junction between the actuator and the valve on the canister so that the inflator and sealant does not escape at that junction. This desirable feature is achieved by providing for rotation of the finger tab about an axis which minimizes movement of the valve stem in a direction other than a vertical direction when it is moved between an actuated and unactuated position. By positioning the rotational axis of the finger tab with respect to the actuator body about a rotational axis which is substantially coplanar with the discharge end of the valve stem, when the finger tab is moved between the actuated and unactuated position the discharge end of the valve stem remains in contact with the valve and seat shoulder of the finger tab so that escape of the pressurized contents of the container is minimized. The present invention provides for the path of the finger tab to be more vertical and collinear with the valve stem that it actuates. By following the valve stem line of movement, less actuation force on the finger tab is required and also an improved seal between the valve and the seat shoulder of the finger tab is achieved.

To safeguard against the inadvertent or accidental actuation, the actuator of the present invention has frangible ribs with a base portion formed integrally with the finger tab and a connecting portion formed integrally with the body. The cross-sectional area of the base portion is greater than the cross-sectional area of the connecting portion. The connecting portions of the frangible ribs are frangible by a force of from between 5 to 30 pounds exerted on the finger tab with the base portion remaining connected to the finger tab when the frangible ribs are separated from the actuator body. After the frangible ribs break away from the actuator body they slide against the actuator body to guide the finger tab and reduce lateral movement of the tab as it moves between an actuated and unactuated position or when used with an overcap.

The actuator of the present invention is capable of either continuously or intermittently dispense the pressurized contents of the container. To intermittently dispensing contents of the container, the finger tab is depressed to the actuated position To continuously dispense the pressurized contents of the container, a latch is provided on the body which engages the finger tab when depressed to a latch actuated position slightly beyond the intermittent actuated position and holds the finger tab in the actuated position. The novel latch of the present invention allows the finger tab to be readily released when the desired amount of pressurized contents are released. The hinge portion of the actuator returns the finger tab to an unactivated position when either the latch is released or pressure is removed from the finger tab.

DETAILED DESCRIPTION OF THE INVENTION

Figure 1:
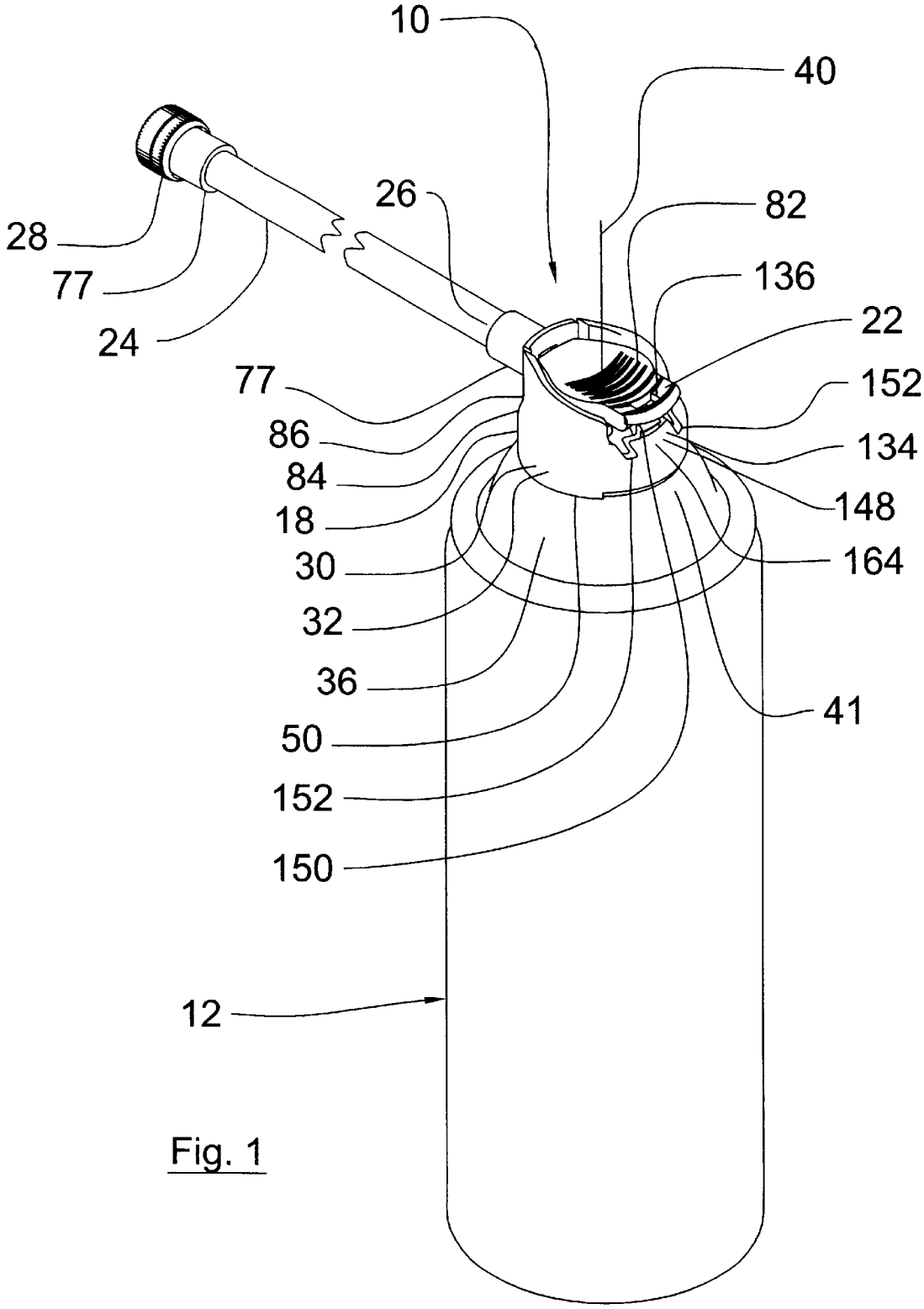
FIG. 1 is a perspective view of the actuator the present invention mounted on a container.
Figure 7:
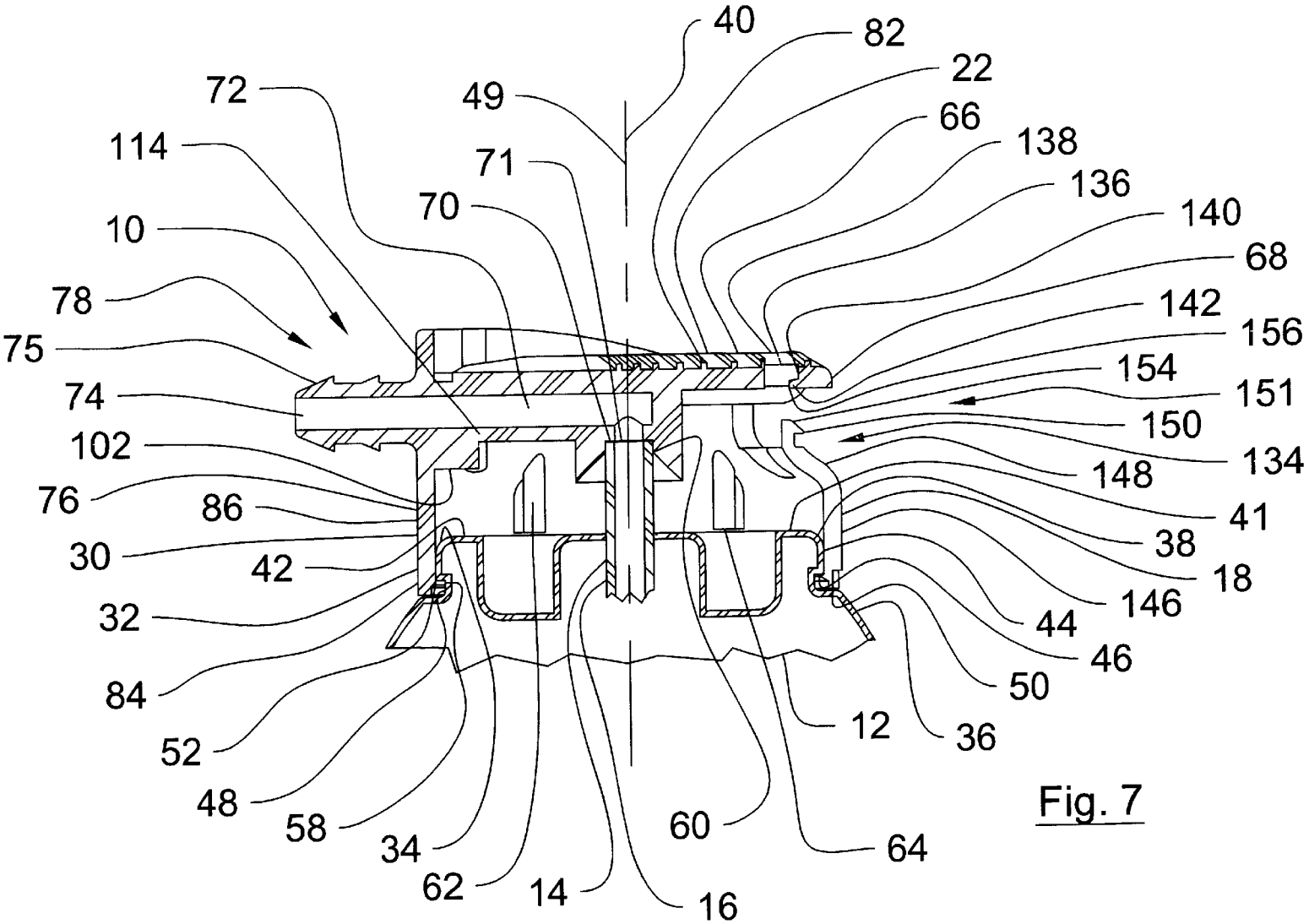
FIG. 7 is a sectional view of the actuator of the present invention and unactuated position and taken along lines 7—7 in FIG. 2.

The present invention provides an improved actuator 10 for use with a container, such as the tire inflation container 12, having a valve 14, as shown in FIGS. 1 and 7. The container 12 has pressurized contents therein which are releasable from the valve 14 having an upstanding valve stem 16 upon actuation of the valve. While the actuator 10 is described in connection with a tire inflation container, it should be understood that the actuator 10 of the present invention may be used with containers having other contents, such as freon for recharging and other aerosol dispensing applications.

The actuator 10 of the present invention has a generally cylindrical body 18 having a central aperture 20 therethrough for receiving the upstanding valve stem 14 therein when the actuator is attached to the container 12, as shown in FIGS. 1–6. The actuator 10 also has a finger tab 22 which is positioned across the central aperture 20 of the body 18 for actuating the valve 14 and receiving the pressurized contents of the container 12 from the upstanding valve stem 16 upon actuation of the valve 14.

A discharge tube 24 is provided having an actuator attachment end 26 for attachment to the actuator 10 and another end 28 for attachment to a pneumatic tire valve. When the actuator 10 is moved to actuate the valve 14, the pressurized contents of the container 12 flows through the valve 14, the actuator 10 and discharge tube 24, which when attached to a pneumatic tire valve, consequently flows into a pneumatic tire.

To attach the actuator 10 to the container 12, the actuator body 18 has a lower attachment skirt 30 having an outer surface 32 and an inner surface 34 as seen in FIGS. 1–8. The container 12 has a valve end 36 with a generally circular flange 38 formed about the central axis 40 of the top 41 of the container 12. The flange 38 extends outwardly and away from the central axis 40 and has a top portion 42 defining a portion of the valve end 36 of the container, a generally circular side portion 44, and a bottom portion 46 extending radially inwardly of the side portion 44 towards the central axis 40 and defining part of the container detent 48 positioned beneath the flange 38.

The inner surface 34 of the actuator's attachment skirt 30 is formed to be received by the flange 38 of the container 12 and is generally circular, formed about the central axis 49 of the aperture 20 of the body 18. The inner surface 34 terminates in a bottom edge 50. When the actuator 10 is attached to the container 12, the central axis 40 of the container and the central axis 49 of the actuator body are in alignment and coextensive with each other. The diameter of the inner surface 34 is slightly larger than the diameter of the side portion 44 of the container 12.

The attachment skirt 30 of the body 18 also has an inwardly extending flange 52 adjacent the bottom edge 50 for attaching the actuator 10 to the container 12. The internal flange 52 has a top and bottom portion 54, 56 respectively which extend inwardly towards the central axis and terminate in an internal side portion 58 positioned inward of the inner surface 34 of the actuator body 18.

Attachment of the actuator 10 to the container 12 is achieved by alignment of the central axes 40, 49 of the container 12 and actuator 18 respectively. The valve stem 14 is received in the stem receiving aperture 60 as will be hereinafter more fully described and the bottom portion 56 of the internal flange 52 is positioned adjacent the top portion 42 of the flange 38.

An axial force is exerted on the actuator 10 and the container 12 along their common central axes 40, 49 urging them to an assembled condition. Due to the flexibility of the lower attachment skirt 30, the inwardly extending flange 52 expands when its bottom portion 56 is pressed into the top portion 42 of the circular container flange 38 and the side portions 44, 58 of the flange 38 and inwardly extending flange 42 respectively are in contact until the container detent 48 receives the inwardly extending flange 52 therein. In this assembled position the top portion 54 of the inwardly extending flange 52 is positioned in the container detent 48 with the top portion 54 of the inwardly extending flange 52 in contact with the bottom portion 46 of the container flange 38.

In order to prohibit further downward movement of the actuator 10 with respect to the container 12, the actuator body 18 has retainer bosses 62 having bottom surfaces 64 in contact with the top portion 42 of the container flange 38 when the actuator and the container are in the assembled position. The bottom surfaces 64 are positioned so that they are in engagement with the top portion 42 when the inwardly extending flange 52 is positioned in the container detent 48. The retainer bosses 62 prevent further downward movement of the actuator 10 with respect to the container 12 and provide for the securement of the actuator to the container.

To provide for the flow of the pressurized contents of the container 12 through the finger tab 22 to the discharge tube 24, the finger tab 22 has a bottom surface 65 in which the stem receiving aperture 60 of the finger tab 22 is formed and also has a top surface 66 and a side surface 68 connecting the top and bottom surfaces 66, 65. The stem receiving aperture 60 through the bottom surface 65 terminates in a valve seat shoulder 70 which contacts the discharge end 71 of the valve stem 16 when moving the valve 14 from an unactuated to an actuated position, shown in FIGS. 7 and 8 respectively.

The finger tab 22 has a passageway 72 extending through the valve seat shoulder 70 to the discharge orifice 74 in the side 68 of the finger tab 22. The actuator 10 of the present invention advantageously provides for the side discharge of the pressurized contents of the container through the side discharge orifice 74. The known containers in some instances must be inverted to discharge the pressurized contents properly and other known containers must be in an upright position to properly discharge the pressurized contents. By providing for side discharge, the container 12 may be positioned in either an upright position or an inverted position.

The finger tab 22 also has a discharge tube connector 75 formed integrally with the side surface 68 of the finger tab 22. The actuator attachment end 26 of the discharge tube 24 is attached to the discharge tube connector 75 by sliding the discharge tube over the discharge tube connector with a friction fit and securing that connection with a collar 77. It should be understood that it is within the contemplation of this invention to use a wide variety of known connections between the discharge tube and the discharge orifice.

Figure 8:
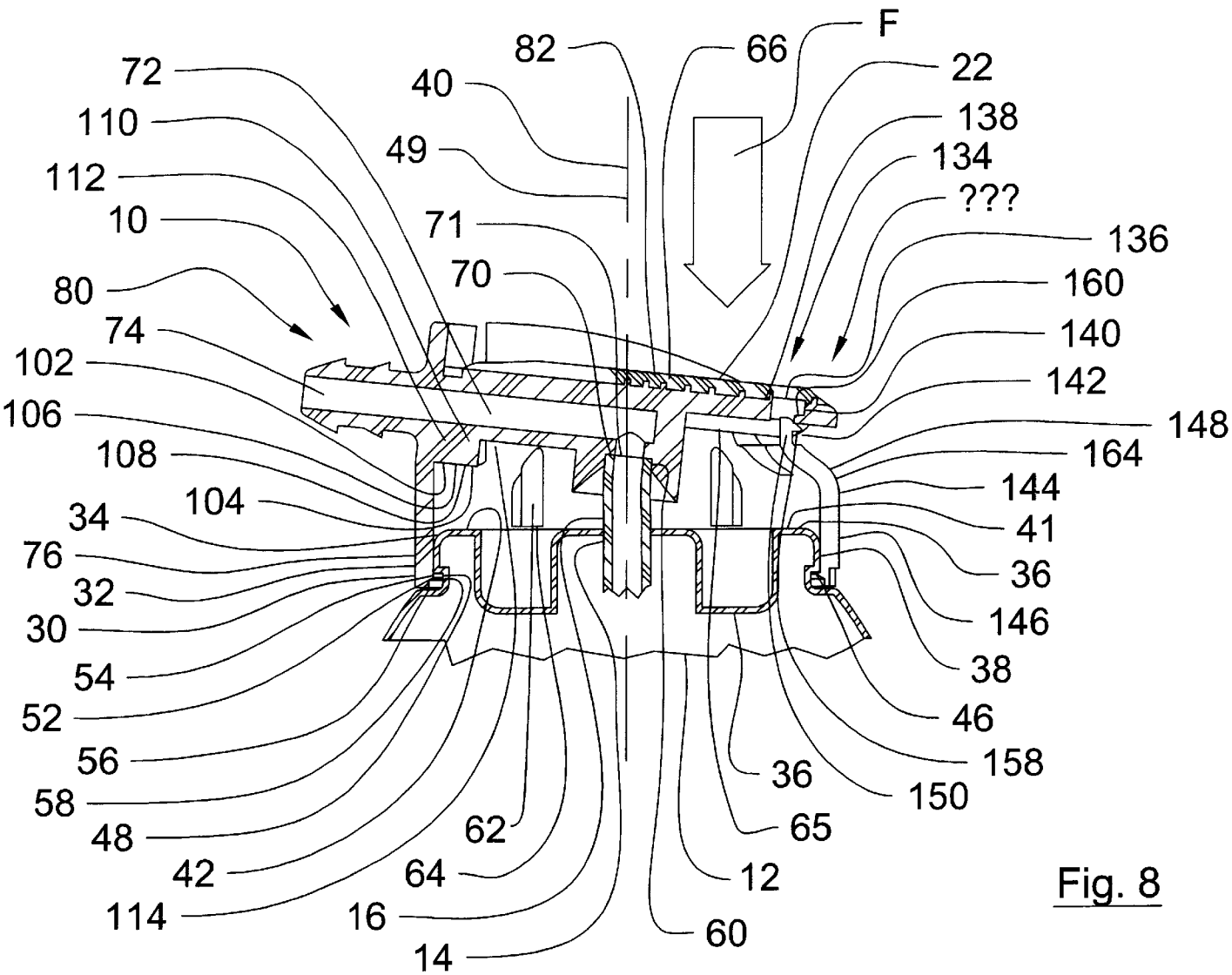
FIG. 8 is a sectional view of the actuator shown in FIG. 7 in an activated position.
Figure 9:
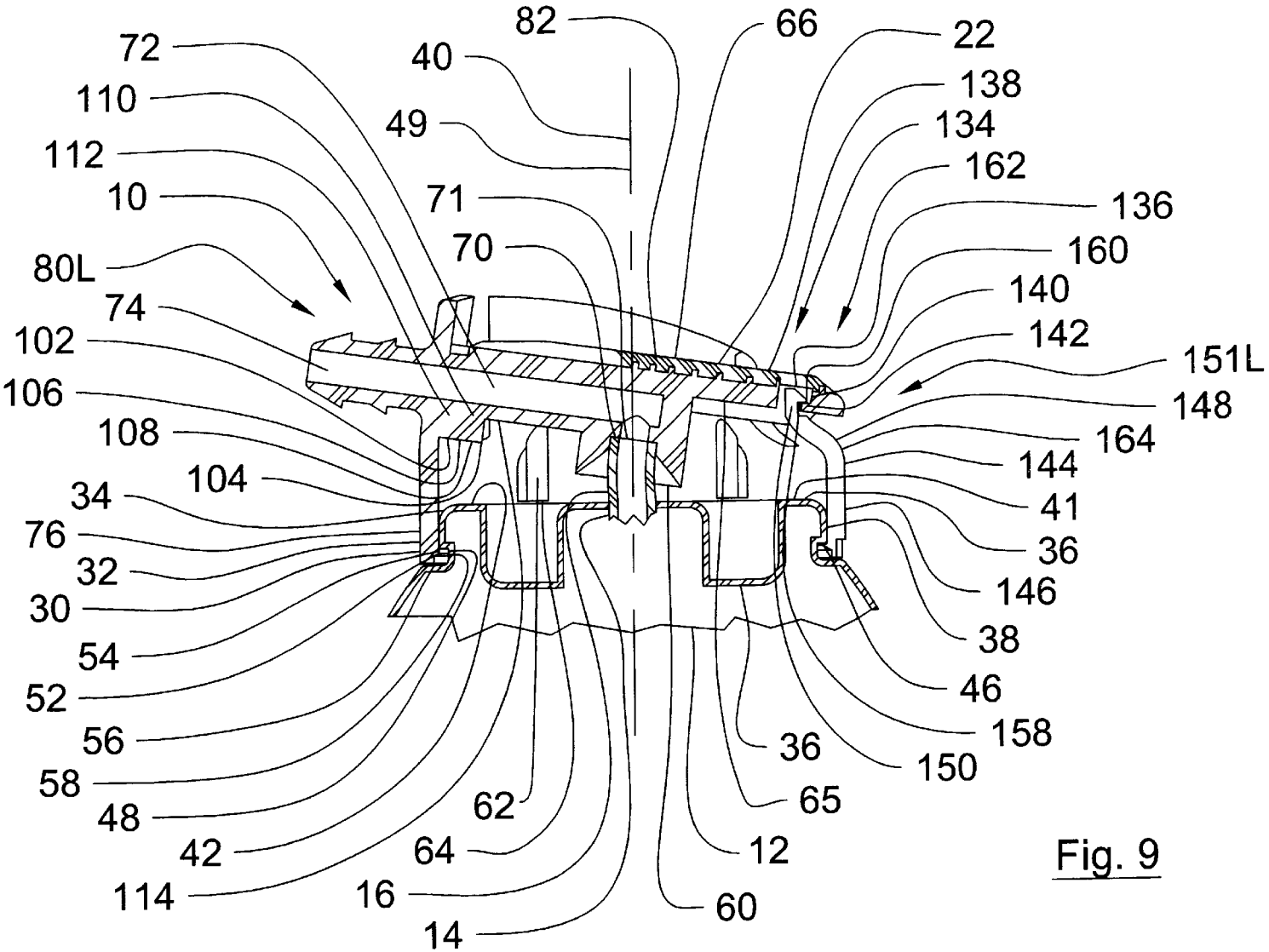
FIG. 9 is a sectional view of the actuator shown in FIG. 7 in an locked activated position.

To connect the finger tab 22 to the body 18, the actuator 10 has a hinge portion 76 which allows for movement of the finger tab between an unactuated position 78, shown in FIG. 7, in which the valve 14 is not actuated and an actuated position 80, shown in FIG. 8, in which the valve 14 is actuated to release the pressurized contents of the container or the locked actuated position 80L shown in FIG. 9. The valve 14 is designed to be activated when it is moved as is known in the art. In the unactuated position 78, the valve stem 16 is in a raise position and when the valve stem is depressed to the actuated position 80, valve 14 is opened and the pressurized contents of the container 12 is released through the valve in a known manner.

To move the finger tab 22 from the unactuated position 78 to the activated position 80, the operators finger is placed on the top surface 66 of the finger tab 22 and a force "F" is exerted in a direction towards the container 12. The top surface 66 has a series of ridges 82 to provide a frictional surface for contacting the operators finger. As the finger tab is to moved the valve seat shoulder 70 contacts the discharge end 71 of the valve stem 16 and exerts a force on the valve stem to move it to an actuated position 80.

Figure 4:
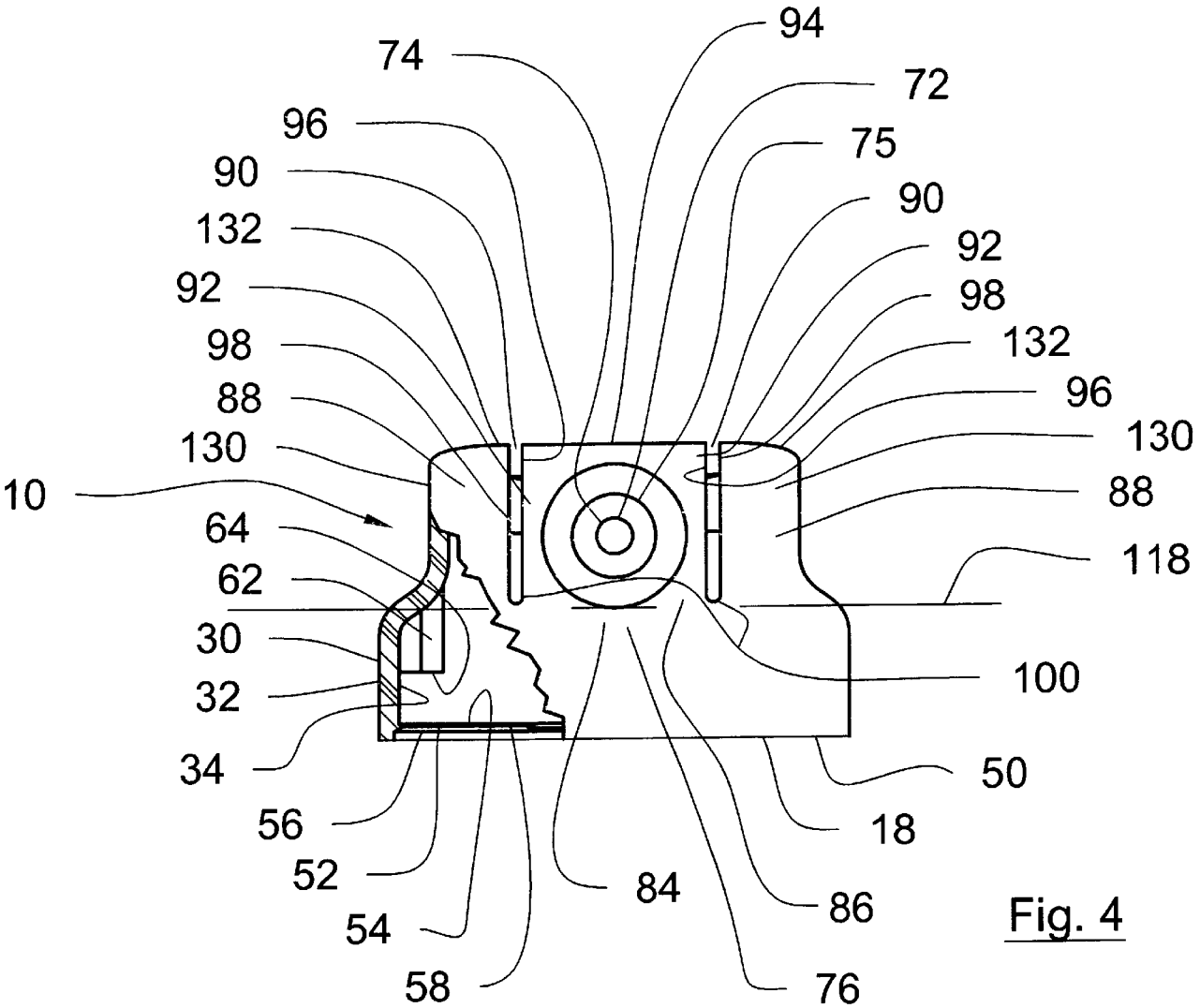
FIG. 4 is a front view of the actuator the present invention.
Figure 5:
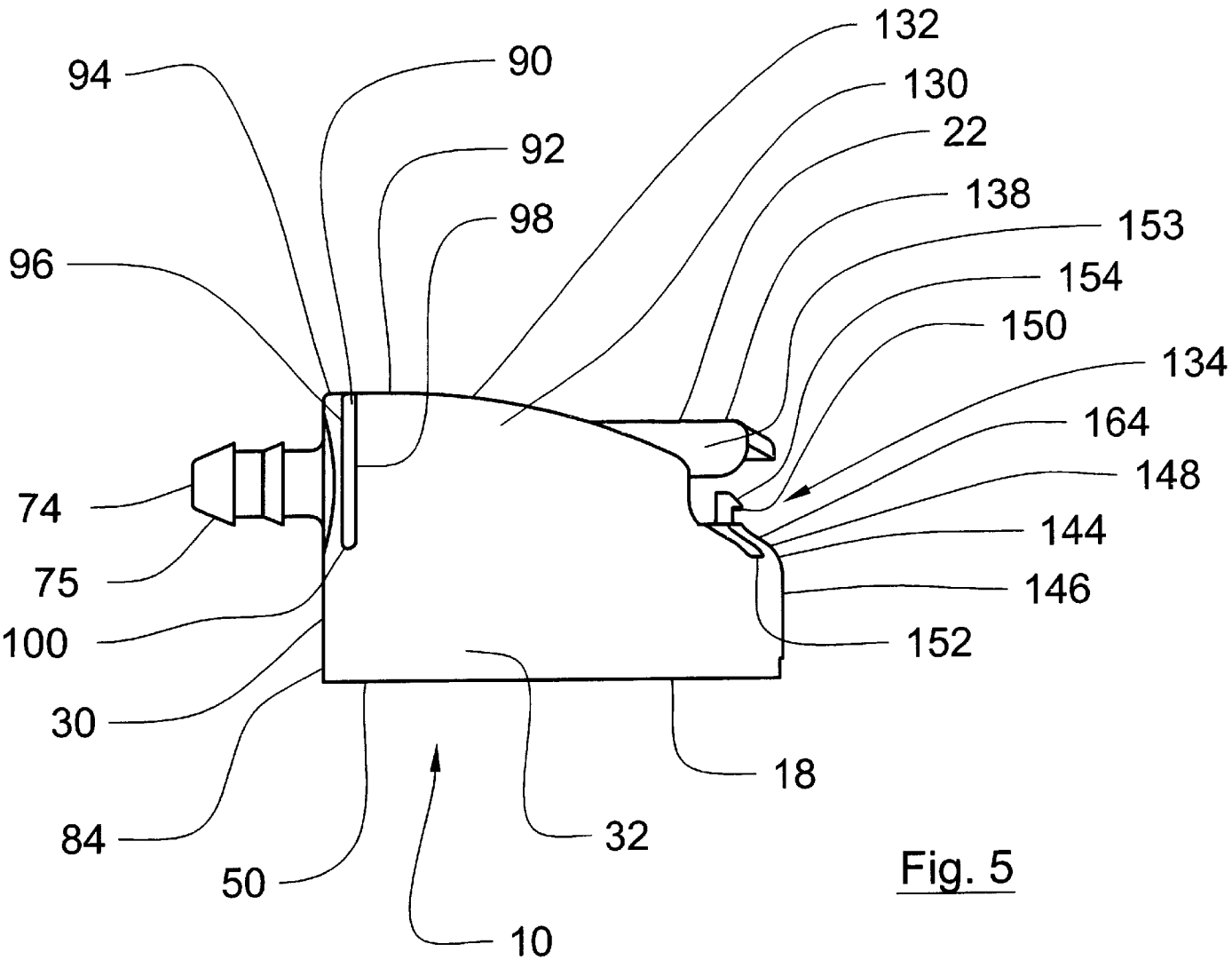
FIG. 5 is a side view of the actuator the present invention.
Figure 6:
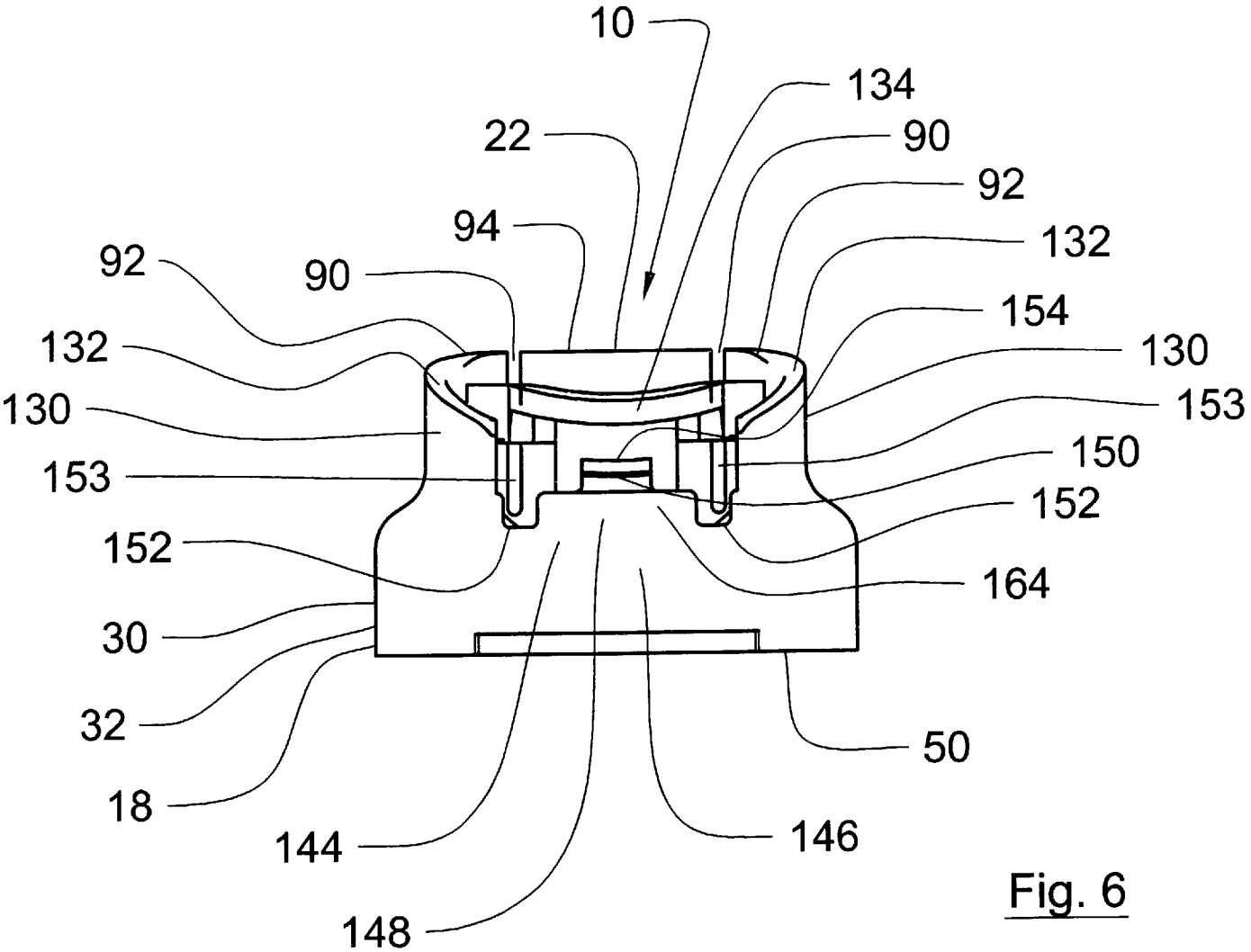
FIG. 6 is a rear view of the actuator of the present invention.

The actuator hinge portion 76 of the present invention provides an actuator that is easy to activate without requiring substantial finger pressure on the finger tab to move it from an unactivated position 78 to an activated position 80. As seen in FIG. 4, the actuator hinge portion 76 has a body connecting portion 84, and an upright intermediate portion 86 extending upwardly from the body connecting portion in a direction substantially parallel to the longitudinal axis of the body.

The body connecting portion 84 is separated from the protective skirt 88 of the body on each side by notches 90 extending from the top edge 92 of the cylindrical body 18 and the top edge 94 of the finger tab 22 toward the bottom edge 50 of the cylindrical body. The notches 90 are defined by a finger tab notch surface 96 and a body notch surface 98 and terminate in a bottom surface 100 positioned below a plane perpendicular to the central axis 49 of the actuator body and passing through the valve seat shoulder 70 and discharge end 71 of the valve stem when the container is attached to the actuator. The notches 90 reduce the force required to move the finger tab from the unactuated position to the actuated position.

The actuator hinge portion 76 also has a finger tab connecting portion of 92 connecting the upright intermediate portion 86 to the finger tab 22. The finger tab connecting portion of 92 also has a reinforcing rib 102, shown in FIGS. 3 and 7–9, formed integrally with both the bottom 64 of the finger tab 22, the finger tab connecting portion of 92 and the the upright intermediate portion 86 of the actuator hinge 76. The reinforcing rib 102 is provided to implement ejection of the actuator from the injection molding die and also assist in moving the finger tab 22 to improve the connection between the discharge end 71 of the valve stem 16 and the valve seat shoulder 70 of the finger tab 22 as will be hereinafter more fully described.

The reinforcing rib 102 has a cylindrical portion 104 and a connecting rib portion 106 extending from the side 108 of the cylindrical portion. The cylindrical portion 104 has a diameter greater than the width of the connecting rib 106. The top 110 of the cylindrical portion 104 and the top 112 of the connecting rib portion 106 is formed integrally with the bottom 64 of the finger tab 22 formed by the finger tab conduit portion 114.

The finger tab conduit portion 114 extends from the valve seat shoulder 70 to the tube discharge orifice 74 and defines the passageway 72 therein. The finger tab conduit portion 114 is relatively substantial in size in comparison with the other portions of the finger tab 22 and provides rigidity to the finger tab 22.

As seen in FIG, 3, the connecting rib 106 is also formed integrally with the inside surface 116 of the finger tab connecting portion 92 and the the upright intermediate portion 86 of the actuator hinge 76. By connecting the tops 110, 112 of the reinforcing rib 102 and the connecting rib 106 to the finger tab connecting portion of 92, a relatively rigid connection is achieved and assists in providing for rotation of the finger tab 22 about a rotational axis 118, shown in FIG. 4, which is substantially coplanar with the valve seat shoulder 70 or slightly below that plane.

The actuator 18 of the present invention provides an improved connection between the finger tab 22 and the discharge end 71 of the valve stem 16 which maintains the connection between the actuator and the valve on the canister so that leakage of the inflator and sealant is minimized. This desirable feature is achieved by providing for rotation of the finger tab 22 about an axis 118 which minimizes movement of the valve stem in a direction other than a vertical direction when it is move between an unactuated position 78 and an actuated position 80, or 80L.

By positioning the rotational axis 118 of the finger tab 22 about a rotational axis which is substantially coplanar with the valve seat shoulder 70, when the finger tab is moved between the unactuated position 78 and an actuated position 80, 80L, the discharge end of the valve stem remains in contact with the valve and seat shoulder of the finger tab to provide an improved seal therebetween so that the pressurized contents of the container 12 does not escape therefrom.

The rotational axis 118 of the finger tab 22 is substantially in a plane that passes through the valve seat shoulder 70 of the actuator and the discharge end 71 of the valve stem 16 when the actuator is in the unactuated position which plane is also substantially perpendicular to the central axis is 49 of the body 18. It should be recognized that the axis 118 may be slightly below or above that plane while achieving this advantageous feature of the present invention. The present invention provides for the path of the finger tab to be substantially vertical and collinear with the valve stem 16 that it actuates. By following the valve stem line of movement, less actuation force on the finger tab is required and also an improved seal between the valve and the seat shoulder of the finger tab is achieved.

Figure 2:
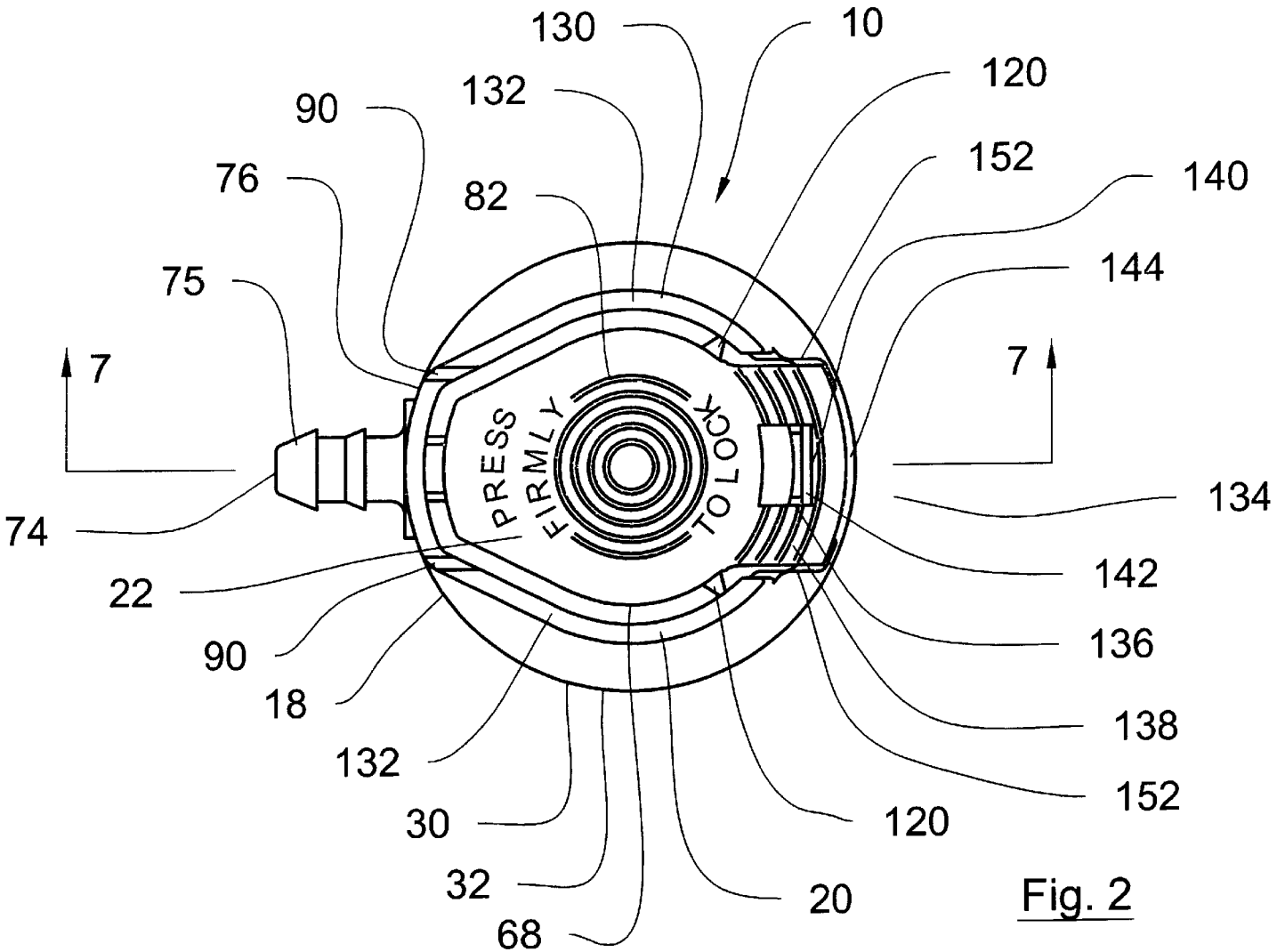
FIG. 2 is a top view of the actuator of the present invention.
Figure 3:
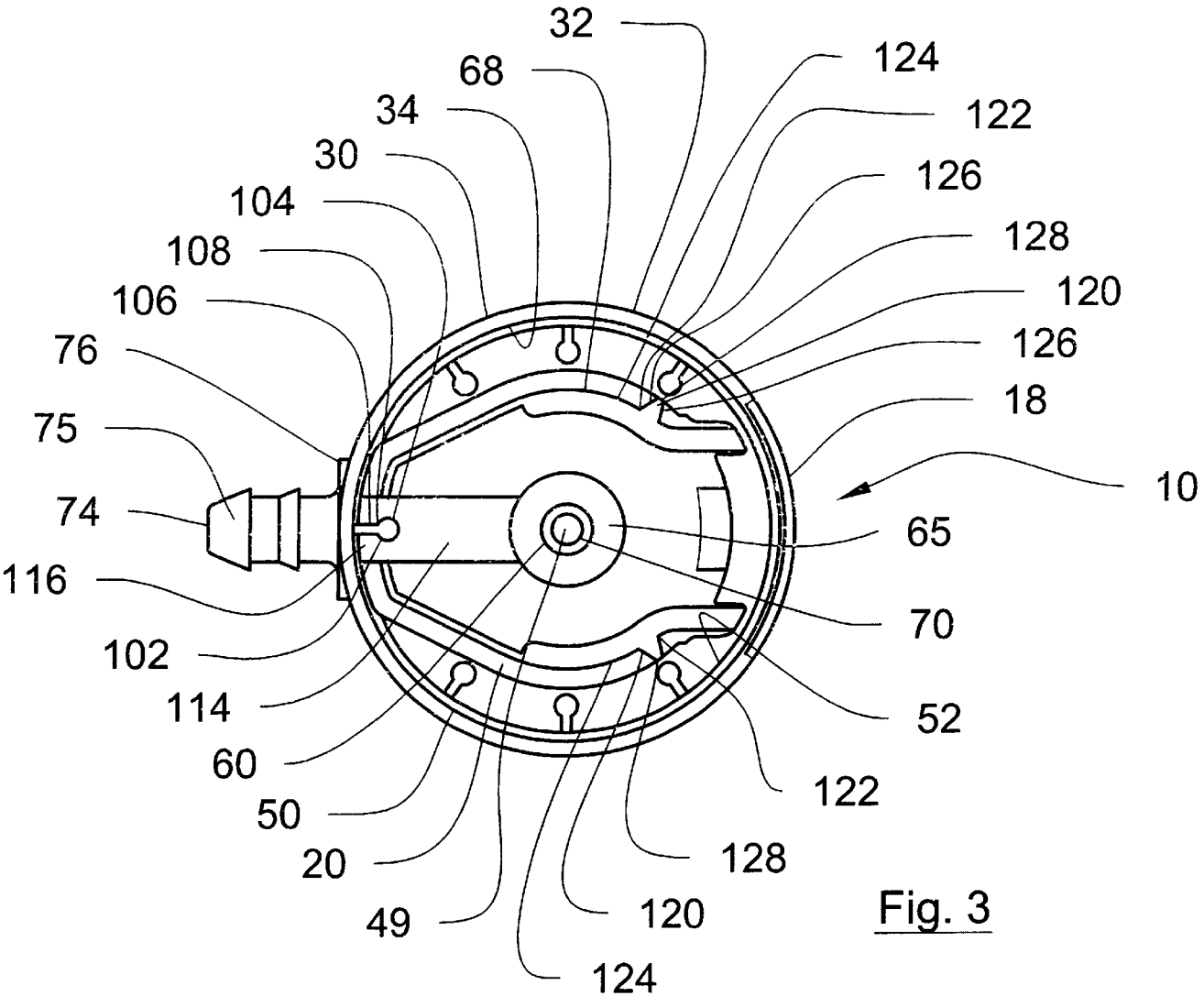
FIG. 3 is a bottom view of the actuator of the present invention.

To safeguard against inadvertent or accidental actuation, the actuator 10 the present invention has frangible ribs 120 with a base portion 122 formed integrally with the outer side 124 of the finger tab 22 as seen in FIGS. 2 and 3. The frangible ribs 120 have converging sides 126 which converge from the base portion 122 to the connecting portion 128 of the frangible ribs. The connecting portion 128 is formed integrally with the body 18.

The body 18 has extended side walls or a protective rim 130 extending from the body notch surfaces 98 and away from the finger tab connecting portion 92. The protective rim 130 has a top edge 132 which is positioned above the portion of the finger tab 22 adjacent the finger tab connecting portion 92 as seen in FIGS. 2–6. The protective rim 130 protects against inadvertent contact with the finger tab and accidental actuation of the actuator 10.

The connecting portion 128 of the frangible ribs 120 is formed integrally with inner surface 130 of the protective rim 132. A vertical line passing through inner surface 130 is substantially parallel to the central axis 49 of the actuator 10. The cross-sectional area of the base portion 122 is greater than the cross-sectional area of the connecting portion 128. The connecting portions 128 of the frangible ribs 120 are frangible by a force of from between 5 to 30 pounds exerted on the finger tab 22.

The cross-sectional area of the base portion 122 is sufficiently greater than the cross-sectional area of the connecting portions so that the base portion remains connected to the finger tab when the frangible ribs are separated from the actuator body. It has been found that this favorable feature is realized when the cross-sectional area of the connecting portion 128 is less than 50 percent of said cross-sectional area of the base portion 122. Accordingly, when a force of from between 5 to 30 pounds is exerted on the finger tab, the connecting portion 128 breaks away from the protective rim 130 at the junction therebetween.

After the frangible ribs break away from the actuator body, the connecting portions 128 slide against the inner surface 130 of the protective rim 132 to guide the finger tab and reduce lateral movement of the tab as it moves between an actuated and unactuated position. The frangible ribs are positioned rearward of a plane which passes through the central axis 49 and is substantially parallel to the rotational axis 118. Since the finger tab rotates about the rotational axis 118, when the frangible ribs 120 are so positioned, they resist any force exerted on the finger tab 22 other than those in a substantially vertical direction along the axis 49. By maintaining the finger tab for moving along the line of direction along the axis 49, the seal between the valve and 36 of the valve 14 and the valve seat shoulder 70 of the finger tab 22 is maintained so that leakage of the contents of the cylinder at that junction is minimized.

The actuator 10 of the present invention is capable of either continuously or intermittently dispensing the pressurized contents of the container 12. To continuously dispense the pressurized contents of the container, a latch device 134 is provided on the body 18 which engages the finger tab 22 when depressed slightly beyond the actuated position 80 to a latched or locked actuated position 80L and holds the finger tab in the actuated position as shown in FIGS. 2, 5, 6, 7–9.

The latch device 134 includes an aperture 136 in the rearward portion 138 of the finger tab 22. The rear surface 140 of the aperture 136 has a ledge 142 extending therefrom. The latch device 134 includes a movable latch portion 144 having its lower end 146 connected to the lower attachment skirt 30. The movable latch portion 144 also has an intermediate portion 148 extending from the lower end 146 towards the finger tab 22 and terminating in the latch or retaining portion 150. The intermediate portion 148 is separated from the lower attachment skirt 30 by notches 152 on each side of the intermediate portion. The finger tab 22 has reinforcing portions 153 adjacent the aperture 136 and extending from the top surface 66 of the finger tab 22 downwardly towards the latch 150 to provide rigidity and strength to the rearward portion 138 of the finger tab 22.

When the finger tab 22 is moved from the unactuated to the locked actuated position 78, 80L respectively, the notches 152 decrease the resistance of the latch 150 in movement between its unlocked or unlatched position 151, shown in FIG. 7, and its locked or latched position 151L, shown in FIG. 9, and also allow the reinforcing portions 153 to be received in the notches so that movement of the finger tab is not impaired. Accordingly, the intermediate portion is free to move and allow the latch 150 to either engage or disengage the ledge 142 on the finger tab.

If it is desirable to intermittently dispense pressurized contents from the container 12, the operator simply depresses the finger tab 22 to the actuated position 80 until the pressurized contents are dispensed. When a sufficient amount has been dispensed, the operator releases pressure on the finger tab and the finger tab moves to the unactivated position 78. On the other hand, if it is desirable to continuously dispense pressurized contents from the container 12, the operator depresses the finger tab 22 until the top angular surface 154 of the latch 150 contacts the bottom surface 156 of the ledge 142.

As the operator continues to depress the finger tab 22, the angular surface 154 of the latch 150 cams against the bottom surface 156 of the ledge to move the latch 150 inwardly towards the aperture 136 until the bottom surface 158 of the latch passes the top surface 160 of the ledge. At this point, the latch 150 moves backward and away from the aperture 136 with the bottom surface 158 of the latch in contact with the top surface 160 of the ledge with the finger tab in a locked position 162 as seen in FIG. 8. This engagement between the latch 150 and the ledge 142 operates to hold the finger tab 22 in the locked activated position 80L so the operator can remove pressure from the finger tab while the pressurized contents of the container 12 continues to be dispensed.

In some cases is unnecessary to dispense the entire contents of the container. The latch device 134 of the present invention allows the operator to release the finger tab from a locked position 162 or locked activated position 80L.

By exerting finger pressure on the back 164 of the intermediate portion 148, the latch 150 moves into the aperture 136 until its bottom surface 158 no longer contacts the top surface 160 of the ledge. At this point, the finger tab 22 moves to the unactuated position 78 so the contents of the container is no longer dispensed. The hinge portion 76 of the actuator returns the finger tab to an unactivated position 78 when either the latch 134 is released or pressure is removed from the finger tab. It should be understood that it is within the compilation of this invention to exert an upward force on the finger tab 22 to force the latch 150 to move into the aperture 136 until its bottom surface 158 no longer contacts the top surface 160 of the ledge 142 so that the finger tab 22 is allowed to move to an unactivated position 78.

The actuator 10 of the present invention provides the advantageous features described above with a design that is capable of being easily manufactured without complex assembly of various components. The actuator of the present invention may be manufactured by injection molding one-piece that is simply mounted on the container 12 after assembly with the discharge tube 24. Such a design provides for substantial commercial advantage in the costs of manufacture and assembly of the actuator.

The invention has been described with reference to the preferred embodiment. Obviously, modifications and alterations will occur to others upon reading and understanding the specification. It is our intention to include all modifications and alterations in so far as they are within the scope of the appended claims or equivalents thereof.

We claim:

1. An actuator for dispensing the pressurized contents of a container of the type having a valve end with an upstanding valve stem protruding from the valve end of the container, which valve stem has a discharge end through which the pressurized contents of the container is discharged, said actuator comprising:

a body having an aperture and an outer peripheral surface, said body adapted for attachment to the container with the valve stem positioned in said aperture, a finger tab positioned across said aperture and having a discharge orifice, said finger tab having a stem receiving aperture for receiving the valve stem therein when said actuator is attached to the container, and a valve seat shoulder for contacting the discharge end of the valve stem when the container is attached to said actuator, said finger tab having a passageway extending through said valve seat shoulder and extending through said discharge orifice, said finger tab having a locking aperture therethrough, a hinge portion connecting said finger tab to said body, said hinge portion allowing for movement of said finger tab between an unactuated position in which the valve is not actuated and an actuated position in which the valve is actuated to release the pressurized contents of the container when said actuator is attached to the container, a latch device including a ledge defining a portion of said locking aperture in said finger tab, and a latch movably attached to said body and movable between an unlatched and latched position, said latch having a retaining portion, said finger tab movable between an unactuated and locked actuated position, said latch extending from said body toward said finger tab with said retaining portion adjacent to and spaced from said locking aperture when said finger tab is in said unactuated position, said retaining portion extending through said locking aperture and engaging said ledge when said finger tab is in said locked actuated position, and said finger tab movable to said unactuated position by exerting a force on one of said latch and said finger tab to release said finger tab from engagement with said retaining portion.

2. An actuator for dispensing the pressurized contents of a container of the type having a valve end with an upstanding valve stem protruding from the valve end of the container, which valve stem has a discharge end through which the pressurized contents of the container is discharged as described in claim 1 in which said finger tab is movable between an unactuated, actuated and locked actuated positions, said finger tab movable from said unactuated to said actuated position when an actuating force is exerted on said finger tab, and in said actuated position said retaining portion of said latch is not in engagement with said ledge and said finger tab is movable from said actuated to said unactuated position when the actuating force is removed from said finger tab.

3. An actuator for dispensing the pressurized contents of a container of the type having a valve end with an upstanding valve stem protruding from the valve end of the container, which valve stem has a discharge end through which the pressurized contents of the container is discharged as described in claim 1 said body having a lower attachment skirt for attachment to the container, said latch having a lower end connected to said lower attachment skirt of said body, and an intermediate portion extending from said lower end to said retaining portion, said body having notches separating said intermediate portion and said retaining portion of said latch from said lower attachment skirt of said body.

4. An actuator for dispensing the pressurized contents of a container of the type having a valve end with an upstanding valve stem protruding from the valve end of the container, which valve stem has a discharge end through which the pressurized contents of the container is discharged as described in claim 3 in which said intermediate portion of said latch has an outside surface for exerting finger pressure thereon to move the said retaining portion into said aperture on said finger tab and allow said finger tab to return to said unactivated position.

5. An actuator for dispensing the pressurized contents of a container of the type having a valve end with an upstanding valve stem protruding from the valve end of the container, which valve stem has a discharge end through which the pressurized contents of the container is discharged as described in claim 1, in which said hinge portion has a rotational axis substantially coplanar with said valve seat shoulder during actuation of the valve stem by said actuator tab.

6. An actuator for dispensing the pressurized contents of a container of the type having a valve end with an upstanding valve stem protruding from the valve end of the container, which valve stem has a discharge end through which the pressurized contents of the container is discharged as described in claim 1 in which said actuator has at least one frangible rib having a base portion and a connecting portion, said base portion formed integrally with one of said body and said finger tab and said connecting portion formed integrally with the other of said finger tab and said connecting portion, each of said base and connecting portion having a cross-sectional area, said cross-sectional area of said base portion is greater than said cross-sectional area of said connecting portion, said cross-sectional area of said connecting portion of said one frangible rib being frangible by a force of from between five pounds to thirty pounds of force on said finger tab and said cross-sectional area of said the base portion of said one frangible rib being sufficient to remain connected to said one of said body and said finger tab when said one frangible rib is separated from said other of said finger tab and said connecting portion.

7. An actuator for dispensing the pressurized contents of a container of the type having a valve end with an upstanding valve stem protruding from the valve end of the container, which valve stem has a discharge end through which the pressurized contents of the container is discharged as described in claim 1 in which said aperture of said body is formed along a central axis, said body having a top and a bottom edge, said hinge portion having an upright intermediate portion extending in a direction substantially parallel to said central axis of said cylindrical body, said body having notches beside each side of said upright portion of said hinge portion, said notches separating said upright portion from said cylindrical body, said notches extending from said top edge of said cylindrical body in a direction toward said bottom edge of said cylindrical body to a position below a plane passing through said valve seat shoulder and vertical to said central axis.

8. A one-piece integrally molded actuator for dispensing the pressurized contents of a container of the type having a container valve end with an upstanding valve stem protruding from the valve end of the container, which valve stem has a discharge end through which the pressurized contents of the container is discharged, said actuator comprising:

a generally cylindrical body having a central aperture along a central axis, said cylindrical body adapted for attachment to the container with the valve stem positioned in said central aperture, a finger tab positioned across said central aperture and having a top and a bottom surface and a side surface connecting said top and bottom surfaces, said finger tab having a discharge orifice formed in said side surface of said finger tab, said finger tab having a stem receiving aperture for receiving the valve stem therein when said actuator is attached to the container, and a valve seat shoulder for contacting the discharge end of the valve stem when the container is attached to said actuator, said finger tab having a passageway extending through said valve seat shoulder and extending through said discharge orifice, a hinge portion connecting said finger tab to said cylindrical body, said hinge portion having a rotational axis substantially coplanar with said valve seat shoulder.

9. A one-piece integrally molded actuator for dispensing the pressurized contents of a container of the type having a container valve end with an upstanding valve stem protruding from the valve end of the container, which valve stem has a discharge end through which the pressurized contents of the container is discharged as described in claim 8 in which said rotational axis of said hinge portion lies substantially in a plane passing through said valve seat shoulder and vertical to said central axis.

10. A one-piece integrally molded actuator for dispensing the pressurized contents of a container of the type having a container valve end with an upstanding valve stem protruding from the valve end of the container, which valve stem has a discharge end through which the pressurized contents of the container is discharged as described in claim 8 which includes a reinforcing rib formed integrally with said finger tab and said hinge portion.

11. A one-piece integrally molded actuator as described in claim 8, said finger tab having a locking aperture therethrough and a lock releasing portion extending outwardly of said outer peripheral surface of said body, said actuator including a latch device including a ledge defining a portion of said locking aperture in said finger tab, and a latch movably attached to said body and movable between an unlatched and latched position, said latch having a retaining portion, said finger tab movable between an unactuated and locked actuated position, said latch extending from said body toward said finger tab with said retaining portion adjacent to and spaced from said locking aperture when said finger tab is in said unactuated position, said retaining portion extending through said locking aperture and engaging said ledge when said finger tab is in said locked actuated position, and said finger tab movable to said unactuated position by exerting a force on one of said latch and said finger tab to release said finger tab from engagement with said retaining portion.

12. A one-piece integrally molded actuator as described in claim 8, said actuator to having at least one frangible rib having a base portion and a connecting portion, said base portion formed integrally with one of said body and said finger tab and said connecting portion formed integrally with the other of said finger tab and said connecting portion, each of said base and connecting portions having a cross-sectional area, said cross-sectional area of said base portion is greater than said cross-sectional area of said connecting portion, said cross-sectional area of said connecting portion of said one frangible rib being frangible by a force of from between five pounds to thirty pounds of force on said finger tab and said cross-sectional area of said the base portion of said one frangible rib being sufficient to remain connected to said one of said body and said finger tab when said one frangible rib is separated from said other of said finger tab and said connecting portion.

13. A one-piece integrally molded actuator as described in claim 8, in which said aperture of said body is formed along a central axis, said body having a top and a bottom edge, said hinge portion having an upright portion extending in a direction substantially parallel to said central axis of said cylindrical body, said body having notches beside each side of said upright portion of said hinge portion, said notches separating said upright portion from said cylindrical body, said notches extending from said top edge of said cylindrical body in a direction toward said bottom edge of said cylindrical body to a position below a plane passing through said valve seat shoulder and vertical to said central axis.

14. A one-piece integrally molded actuator for dispensing the pressurized contents of a container of the type having a container valve end with an upstanding valve stem protruding from the valve end of the container, which valve stem has a discharge end through which the pressurized contents of the container is discharged, said actuator comprising:

a generally cylindrical body having a central aperture therethrough generally extending along a central axis, said cylindrical body having a top portion terminating in a top edge, and a bottom portion adapted for attachment to the container with the valve stem positioned in said central aperture, said bottom portion terminating in a bottom edge, a finger tab positioned across said central aperture and having a top and a bottom surface and a side surface connecting said top and bottom surfaces, said finger tab having a discharge orifice formed in said side surface of said finger tab, said finger tab having a stem receiving aperture for receiving the valve stem therein when said actuator is attached to the container, and a valve seat shoulder for contacting the discharge end of the valve stem when the container is attached to said actuator, said finger tab having a passageway extending through said valve seat shoulder and extending through said discharge orifice, a hinge portion connecting said finger tab to said cylindrical body, said hinge portion having an upright portion extending in a direction substantially parallel to said central axis of said cylindrical body said body having notches beside each side of said upright portion of said hinge portion, said notches separating said upright portion from said cylindrical body said notches extending from said top edge of said cylindrical body in a direction toward said bottom edge of said cylindrical body to a position below a plane passing through said valve seat shoulder and vertical to said central axis.

15. A one-piece integrally molded actuator as described in claim 14 which includes a reinforcing rib formed integrally with said finger tab and said hinge portion.

16. A one-piece integrally molded actuator as described in claim 14 said finger tab having a locking aperture therethrough and a lock releasing portion extending outwardly of said outer peripheral surface of said body, said actuator including a latch device including a ledge defining a portion of said locking aperture in said finger tab, and a latch movably attached to said body and a movable between an unlatched and latched position, said latch having a retaining portion, said finger tab movable between an unactuated and locked actuated position, said latch extending from said body toward said finger tab with said retaining portion adjacent to and spaced from said locking aperture when said finger tab is in said unactuated position, said retaining portion extending through said locking aperture and engaging said ledge when said finger tab is in a locked actuated position, and said finger tab movable to said unactuated position by exerting a force on one of said latch and said finger tab to release said finger tab from engagement with said retaining portion.

17. A one-piece integrally molded actuator as described in claim 14 in which said hinge portion has a rotational axis substantially coplanar with said valve seat shoulder.

18. A one-piece integrally molded actuator as described in claim 14 in which said actuator has at least one frangible rib having a base portion and a connecting portion, said base portion formed integrally with one of said body and said finger tab and said connecting portion formed integrally with the other of said finger tab and said connecting portion, each of said base and connecting portion having a cross-sectional area, said cross-sectional area of said base portion is greater than said cross-sectional area of said connecting portion, said cross-sectional area of said connecting portion of said one frangible rib being frangible by a force of from between five pounds to thirty pounds of force on said finger tab and said cross-sectional area of said the base portion of said one frangible rib being sufficient to remain connected to said one of said body and said finger tab when said one frangible rib is separated from said other of said finger tab and said connecting portion.

19. An actuator for dispensing the pressurized contents of a container of the type having a valve end with an upstanding valve stem protruding from the valve end of the container which valve stem has a discharge end through which the pressurized contents of the container is discharged, said actuator comprising:

a body having an aperture, said body adapted for attachment to the container with the valve stem positioned in said aperture, a finger tab positioned across said aperture and having a discharge orifice, said finger tab having a stem receiving aperture for receiving the valve stem therein when said actuator is attached to the container, and a valve seat shoulder for contacting the discharge end of the valve stem when the container is attached to said actuator, said finger tab having a passageway extending through said valve seat shoulder and extending through said discharge orifice, said finger tab movable between an unactuated and actuated position, a hinge portion connecting said finger tab to said body, said hinge portion allowing movement of said finger tab to actuate the valve when the container is attached to the container, at least one frangible rib having a base portion and a connecting portion, said base portion formed integrally with one of said body and said finger tab and said connecting portion formed integrally with the other of said finger tab and said connecting portion, each of said base and connecting portions having a cross-sectional area, said cross-sectional area of said base portion is greater than said cross-sectional area of said connecting portion, said cross-sectional area of said connecting portion of said one frangible rib being frangible by a force of from between five pounds to thirty pounds of force on said finger tab and said cross-sectional area of said the base portion of said one frangible rib being sufficient to remain connected to said one of said body and said finger tab when said one frangible rib is separated from said other of said finger tab and said connecting portion.

20. An actuator for dispensing the pressurized contents of a container of the type having a valve end with an upstanding valve stem protruding from the valve end of the container which valve stem has a discharge end through which the pressurized contents of the container is discharged as described in claim 19, wherein said cross-sectional area of said connecting portion is less than fifty percent of said cross-sectional area of said base portion.

21. An actuator for dispensing the pressurized contents of a container of the type having a valve end with an upstanding valve stem protruding from the valve end of the container which valve stem has a discharge end through which the pressurized contents of the container is discharged as described in claim 19 in which said connecting portion of said one frangible rib is adjacent said other of said finger tab and said connecting portion during movement of said finger tab between said unactuated and actuated positions.

22. An actuator for dispensing the pressurized contents of a container of the type having a valve end with an upstanding valve stem protruding from the valve end of the container which valve stem has a discharge end through which the pressurized contents of the container is discharged as described in claim 19 wherein said aperture of said body is formed about a central axis, and wherein said hinge portion connects said finger tab to said body about a rotational axis, said one frangible rib is positioned rearward of a plane which passes through said central axis and said plane is substantially parallel to said rotational axis.

23. An actuator for dispensing the pressurized contents of a container of the type having a valve end with an upstanding valve stem protruding from the valve end of the container which valve stem has a discharge end through which the pressurized contents of the container is discharged as described in claim 19 said finger tab having a locking aperture therethrough and a lock releasing portion extending outwardly of said outer peripheral surface of said body, said actuator including a latch device including a ledge defining a portion of said locking aperture in said finger tab, and a latch movably attached to said body and movable between an unlatched and latched position, said latch having a retaining portion, said finger tab movable between an unactuated and locked actuated position, said latch extending from said body toward said finger tab with said retaining portion adjacent to and spaced from said locking aperture when said finger tab is in said unactuated position, said retaining portion extending through said locking aperture and engaging said ledge when said finger tab is in said locked actuated position, and said finger tab movable to said unactuated position by exerting a force on one of said latch and said finger tab to release said finger tab from engagement with said retaining portion.

24. An actuator for dispensing the pressurized contents of a container of the type having a valve end with an upstanding valve stem protruding from the valve end of the container which valve stem has a discharge end through which the pressurized contents of the container is discharged as described in claim 19 in which said hinge portion has a rotational axis substantially coplanar with said valve seat shoulder.

25. An actuator for dispensing the pressurized contents of a container of the type having a valve end with an upstanding valve stem protruding from the valve end of the container which valve stem has a discharge end through which the pressurized contents of the container is discharged as described in claim 19 in which said aperture of said body is formed along a central axis, said body having a top and a bottom edge, said hinge portion having an upright portion extending in a direction substantially parallel to said central axis of said cylindrical body said body having notches beside each side of said upright portion of said hinge portion, said notches separating said upright portion from said cylindrical body, said notches extending from said top edge of said cylindrical body in a direction toward said bottom edge of said cylindrical body to a position below a plane passing through said valve seat shoulder and vertical to said central axis.

* * * * *